US005908074A

United States Patent [19]

Potts

[11] Patent Number: 5,908,074

[45] Date of Patent: Jun. 1, 1999

[54] FIRE DETECTING VALVE ACTIVATION ASSEMBLY FOR VEHICLE FIRE SUPPRESSION SYSTEMS

[76] Inventor: Laurence A. Potts, 24 Sandalwood St., Pensacola, Fla. 32505

[21] Appl. No.: 09/024,017

[22] Filed: Feb. 16, 1998

[51] Int. Cl.[6] ..... A62C 37/10

[52] U.S. Cl. ..... 169/60; 169/62; 169/19; 169/42; 137/72

[58] Field of Search ..... 169/19, 42, 54, 169/56, 59, 60, 62, DIG. 3; 137/72

[56] References Cited

U.S. PATENT DOCUMENTS

| | | | |
|---|---|---|---|
| 1,616,974 | 2/1927 | Josephson | 169/62 |
| 2,324,552 | 7/1943 | Bailey | 169/42 |
| 3,196,953 | 7/1965 | Young | 169/19 |
| 3,387,662 | 6/1968 | Molgano, Jr. | 169/62 |
| 4,982,798 | 1/1991 | Wang | 169/62 |
| 4,986,365 | 1/1991 | Shieh | 169/60 |
| 5,119,878 | 6/1992 | Lee | 169/62 |
| 5,370,189 | 12/1994 | Deist | 169/62 |
| 5,501,284 | 3/1996 | Clodfelter et al. | 169/54 |
| 5,505,266 | 4/1996 | Fujiki | 169/60 |
| 5,515,691 | 5/1996 | Wertenbach et al. | 62/133 |
| 5,590,718 | 1/1997 | Bertossi | 169/62 |

*Primary Examiner*—Andres Kashnikow
*Assistant Examiner*—Lisa Ann Douglas
*Attorney, Agent, or Firm*—Joseph N. Breaux

[57] ABSTRACT

A fire detecting valve activation assembly for vehicle fire suppression systems that have a pressurized gas fire suppressant cylinder and a pressurized gas fire suppressant distribution line terminating in a release valve having an actuator shaft for closing and opening the release valve. The fire detecting valve activation assembly includes a nozzle and a lead link fire detecting valve activation assembly. The lead link fire detecting valve activation assembly includes a valve body within which the release valve is installed such that an exterior portion of the actuator shaft extends out from the valve body, a valve actuator arm having a retaining link attachment pin extending outwardly therefrom, the valve actuator arm being rigidly coupled to the exterior portion of the actuator shaft, a spring anchoring pin extending from the exterior of the valve body, a biasing spring connected between the valve actuator arm and the spring anchoring pin such that the spring applies a force to the valve actuator arm urging the valve actuator arm in a direction to open the release valve, a retaining link securing screw threadable into a threaded securing screw aperture formed into the valve body, and a lead retaining link connected between the retaining link attachment pin and the retaining link securing screw.

4 Claims, 2 Drawing Sheets

FIRE DETECTING VALVE ACTIVATION ASSEMBLY FOR VEHICLE FIRE SUPPRESSION SYSTEMS

TECHNICAL FIELD

The present invention relates to fire suppression devices and methods and more particularly to a fire detecting valve activation assembly for vehicle fire suppression systems having a pressurized gas fire suppressant cylinder and a pressurized gas fire suppressant distribution line terminating in a release valve having an actuator shaft for closing and opening the release valve; the fire detecting valve activation assembly including a nozzle and a lead link fire detecting valve activation assembly; the lead link fire detecting valve activation assembly including a valve body within which the release valve is installed such that an exterior portion of the actuator shaft extends out from the valve body, a valve actuator arm having a retaining link attachment pin extending outwardly therefrom, the valve actuator arm being rigidly coupled to the exterior portion of the actuator shaft, a spring anchoring pin extending from the exterior of the valve body, a biasing spring connected between the valve actuator arm and the spring anchoring pin such that the spring applies a force to the valve actuator arm urging the valve actuator arm in a direction to open the release valve, a retaining link securing screw threadable into a threaded securing screw aperture formed into the valve body, and a lead retaining link connected between the retaining link attachment pin and the retaining link securing screw such that the valve actuator arm is retained in a position maintaining the release valve in a closed position, the lead retaining link being constructed from a lead that melts when exposed to fire, the lead retaining link having a retaining screw aperture and a retaining pin slot formed therethrough, the retaining pin slot including a retaining pin head insertion opening and a retaining pin shaft locking slot, the retaining pin head insertion opening having a diameter "A" that is greater than the diameter of a retaining pin head of the retaining pin and a retaining pin shaft locking slot with a diameter "B" that is greater than the diameter of a retaining pin shaft of the retaining pin and less than the diameter of the retaining pin head.

BACKGROUND ART

Each year many occupants of vehicles are killed or injured when the occupied vehicle becomes involved in a fire. It would be benefit to these individuals to have a fire suppression system within the vehicle that could detect and extinguish the fire as rapidly as possible. Because the driver of the vehicle can loose control of the vehicle immediately after activation of a fire suppression system within the vehicle, it is important that the fire suppression system include a valve activation assembly that activates the fire suppression system only when the vehicle is actually involved in a fire.

GENERAL SUMMARY DISCUSSION OF INVENTION

It is thus an object of the invention to provide a fire detecting valve activation assembly for vehicle fire suppression systems.

It is a further object of the invention to provide a fire detecting valve activation assembly for vehicle fire suppression systems that activates the fire suppression system only when the vehicle is involved in a fire.

It is a still further object of the invention to provide a fire detecting valve activation assembly for vehicle fire suppression systems that includes a nozzle and a lead link fire detecting valve activation assembly; the lead link fire detecting valve activation assembly including a valve body within which the release valve is installed such that an exterior portion of the actuator shaft extends out from the valve body, a valve actuator arm having a retaining link attachment pin extending outwardly therefrom, the valve actuator arm being rigidly coupled to the exterior portion of the actuator shaft, a spring anchoring pin extending from the exterior of the valve body, a biasing spring connected between the valve actuator arm and the spring anchoring pin such that the spring applies a force to the valve actuator arm urging the valve actuator arm in a direction to open the release valve, a retaining link securing screw threadable into a threaded securing screw aperture formed into the valve body, and a lead retaining link connected between the retaining link attachment pin and the retaining link securing screw such that the valve actuator arm is retained in a position maintaining the release valve in a closed position, the lead retaining link being constructed from a lead that melts when exposed to fire, the lead retaining link having a retaining screw aperture and a retaining pin slot formed therethrough, the retaining pin slot including a retaining pin head insertion opening and a retaining pin shaft locking slot, the retaining pin head insertion opening having a diameter "A" that is greater than the diameter of a retaining pin head of the retaining pin and a retaining pin shaft locking slot with a diameter "B" that is greater than the diameter of a retaining pin shaft of the retaining pin and less than the diameter of the retaining pin head.

It is a still further object of the invention to provide a fire detecting valve activation assembly for vehicle fire suppression systems that accomplishes some or all of the above objects in combination.

Accordingly, a fire detection valve activation assembly for vehicle fire suppression systems having a pressurized gas fire suppressant cylinder and a pressurized gas fire suppressant distribution line terminating in a release valve having an actuator shaft for closing and opening the release valve is provided. The fire detecting valve activation assembly includes a nozzle and a lead link fire detecting valve activation assembly; the lead link fire detecting valve activation assembly including a valve body within which the release valve is installed such that an exterior portion of the actuator shaft extends out from the valve body, a valve actuator arm having a retaining link attachment pin extending outwardly therefrom, the valve actuator arm being rigidly coupled to the exterior portion of the actuator shaft, a spring anchoring pin extending from the exterior of the valve body, a biasing spring connected between the valve actuator arm and the spring anchoring pin such that the spring applies a force to the valve actuator arm urging the valve actuator arm in a direction to open the release valve, a retaining link securing screw threadable into a threaded securing screw aperture formed into the valve body, and a lead retaining link connected between the retaining link attachment pin and the retaining line securing screw such that the valve actuator arm is retained in a position maintaining the release valve in a closed position, the lead retaining link being constructed from a lead that melts when exposed to fire, the lead retaining link having a retaining screw aperture and a retaining pin slot formed therethrough, the retaining pin slot including a retaining pin head insertion opening and a retaining pin shaft locking slot, the retaining pin head insertion opening having a diameter "A" that is greater than the diameter of a retaining pin head of the retaining pin and a retaining pin shaft locking slot with a diameter "B" that is greater than the diameter of a retaining pin shaft of the retaining pin and less than the diameter of the retaining pin head. In a preferred embodiment the nozzle includes a turnable pattern adjustment fitting to allow a user or an installer to adjust the dispersal pattern generated by the nozzle to optimize dispersal of the fire suppressant agent.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
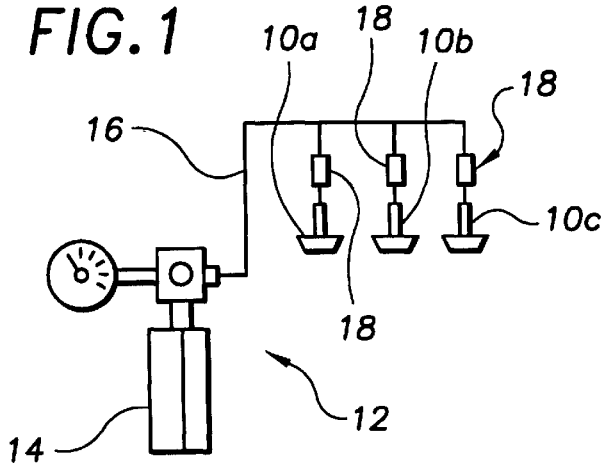
FIG. 1 is a schematic diagram showing an exemplary embodiment of the fire detecting valve activation assembly for vehicle fire suppression systems of the present invention showing an exemplary fire suppression systems including a conventional pressurized gas fire suppressant cylinder, a conventional pressurized gas fire suppressant distribution line that terminates in three release valves; and three of the fire detecting valve activation assemblies of the present invention each including an adjustable nozzle and a lead link fire detecting valve activation assembly.
Figure 2:
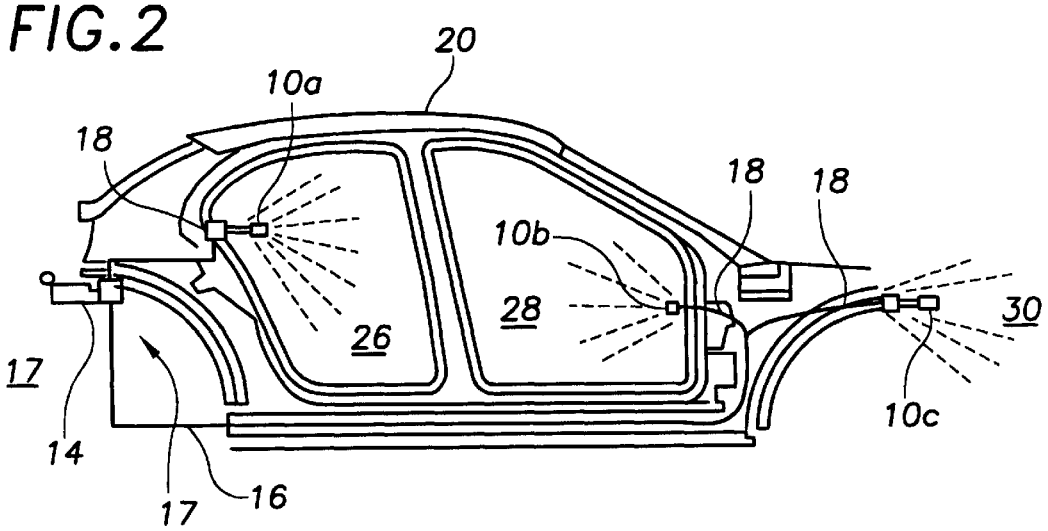
FIG. 2 is a schematic diagram showing the exemplary fire suppression systems of FIG. 1 installed within a representative vehicle with the conventional pressurized gas fire suppressant cylinder installed within the trunk compartment of the vehicle; a conventional stainless steel, vacuum jacketed, pressurized gas fire suppressant distribution line system having three branches each terminating in a release valve; a first fire detecting valve activation assembly installed within the rear of the passenger compartment; a second fire detecting valve activation assembly installed in the forward portion of the passenger compartment; and a third fire detecting valve activation assembly installed within the engine compartment of the vehicle.

FIG. 1 schematically shows three identical exemplary embodiments of the fire detecting valve activation assembly for vehicle fire suppression systems of the present invention, generally designated 10*a–c*, installed within an exemplary fire suppression systems, generally designated 12, that includes a conventional pressurized gas ($CO_2$) fire suppressant cylinder 14 and a conventional pressurized gas fire suppressant distribution line 16 that terminates in three release valves 18. With reference to FIG. 2, fire suppression system 12 is representatively installed within a vehicle body 20 with conventional pressurized gas ($CO_2$) fire suppressant cylinder 14 installed within the trunk compartment 17, pressurized gas fire suppressant distribution line 16 is constructed of stainless steel, vacuum jacketed, pressurized gas line and is connected between fire suppressant cylinder 14 and three release valves 18. Each release valve 18 is installed within a valve body of one of the fire detecting valve activation assemblies 10*a–c*. In this embodiment a first fire detecting valve activation assemblies 10*a* is installed within the rear of the passenger compartment 26; a second fire detecting valve activation assembly 10*b* installed in the forward portion 28 of the passenger compartment; and a third fire detecting valve activation assembly 10*c* is installed within the engine compartment 30 of vehicle body 20.

Figure 3:
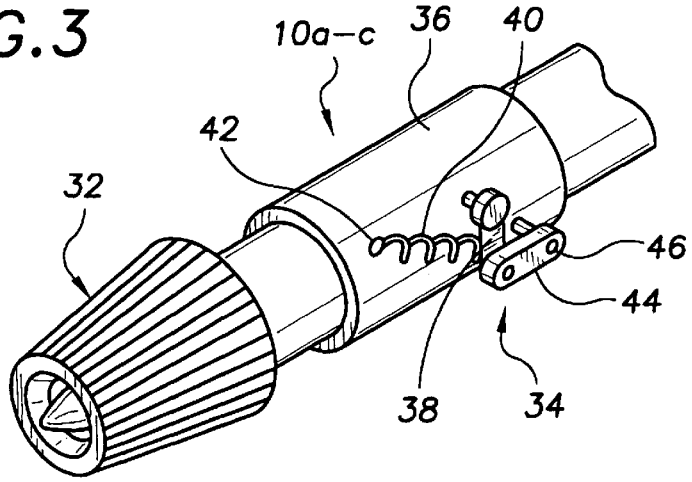
FIG. 3 is a detail perspective view of an exemplary embodiment of the fire detecting valve activation assembly of the present invention including the user adjustable nozzle and the lead link fire detecting valve activation assembly, the lead link fire detecting valve activation assembly including the valve body, the valve actuator arm, the biasing spring, the spring anchoring pin, the lead retaining link, and the retaining link securing screw.
Figure 4:
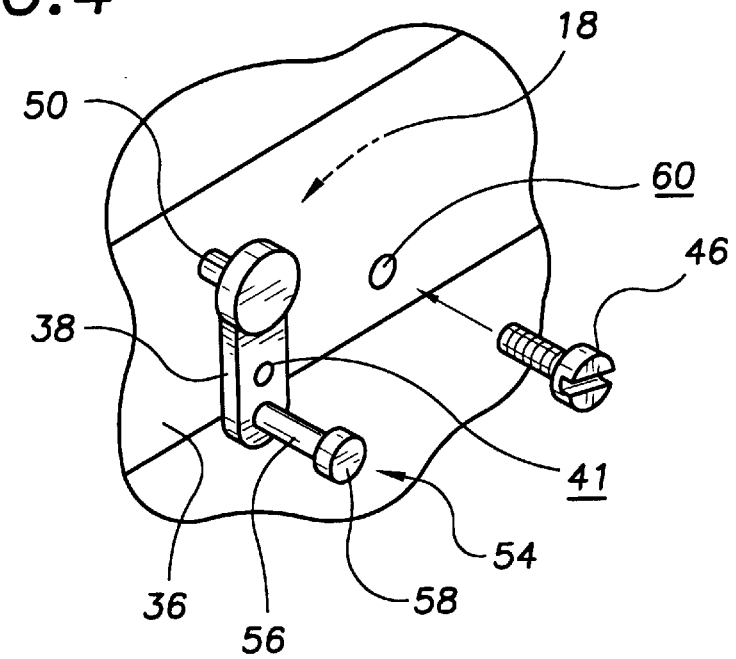
FIG. 4 is a partial perspective view showing the valve body; the valve actuator arm with the retaining link attachment pin having the retaining pin shaft and the retaining pin head; the retaining link securing screw; and the threaded securing screw aperture formed into the exterior of the valve body.

With reference to FIG. 3, each fire detecting valve activation assembly 10*a–c* is of identical construction and each includes a user adjustable, rotatable nozzle, generally designated 32, and a lead link fire detecting valve activation assembly, generally designated 34. Lead link fire detecting valve activation assembly 34 includes a valve body 36, a valve actuator arm 38, a biasing spring 40, a spring anchoring pin 42, a lead retaining link 44, and a retaining link securing screw 46. With reference to FIG. 4, each valve body 36 has a release valve 18 installed therein with the actuator shaft 50 extending out through valve body 36 and rigidly connected to valve actuator arm 38. Valve actuator arm 38 has a spring connecting aperture 41 formed through a center portion thereof and a retaining link attachment pin, generally designated 54, having a retaining pin shaft 56 and a retaining pin head 58 provided at a far end thereof. In this embodiment, retaining link securing screw 46 is a conventional threaded screw that is companionately threaded to engage the internal threading of a threaded securing screw aperture 60 that is formed into the exterior of valve body 36. With reference back to FIG. 3, biasing spring 40 is connected between spring anchoring pin 42 and valve actuator arm 38 and is under tensional extension when valve actuator arm 38 is positioned such that release valve 18 is closed. Valve actuator arm 38 is retained in this position by connecting lead retaining link 44 between valve actuator arm 38 and retaining link securing screw 46.

Figure 5:
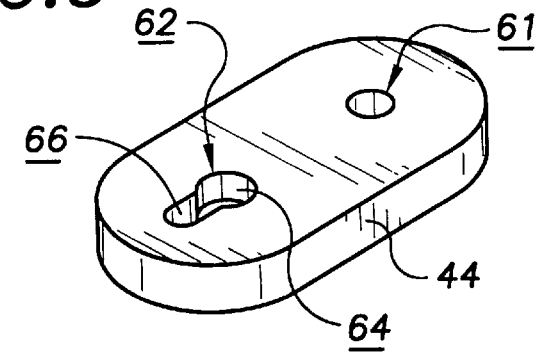
FIG. 5 is a perspective view of the lead retaining link in isolation showing the retaining screw aperture and the retaining pin slot including the retaining pin head insertion opening and the retaining pin shaft locking slot.
Figure 6:
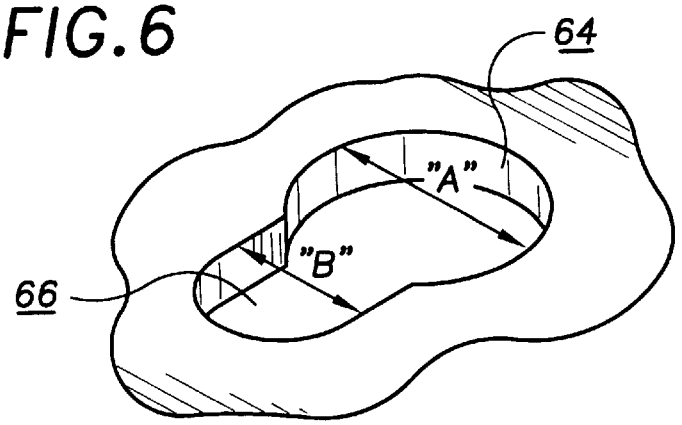
FIG. 6 is a detail perspective view of the retaining pin slot of the lead retaining link showing the retaining pin head insertion opening with a diameter "A" that is greater than the diameter of the retaining pin head and the retaining pin shaft locking slot with a diameter "B" that is greater than the diameter of the retaining pin shaft and less than the diameter of the retaining pin head.

With reference to FIG. 5, lead retaining link 44 is of lead construction and includes a cylindrical shaped retaining screw aperture 61 and a retaining pin slot, generally designated 62, that includes a retaining pin head insertion opening 64 and a retaining pin shaft locking slot 66. With reference to FIG. 6, retaining pin head insertion opening 64 has a diameter "A" that is greater than the diameter of retaining pin head 58. Retaining pin shaft locking slot 66 has a diameter "B" that is greater than the diameter of retaining pin shaft 56 and less than the diameter of retaining pin head 58.

It can be seen from the preceding description that a fire detecting valve activation assembly for vehicle fire suppression systems has been provided that activates the fire suppression system only when the vehicle is involved in a fire; and includes a nozzle and a lead link fire detecting valve activation assembly; the lead link fire detecting valve activation assembly including a valve body within which the release valve is installed such that an exterior portion of the actuator shaft extends out from the valve body, a valve actuator arm having a retaining link attachment pin extending outwardly therefrom, the valve actuator arm being rigidly coupled to the exterior portion of the actuator shaft, a spring anchoring pin extending from the exterior of the valve body, a biasing spring connected between the valve actuator arm and the spring anchoring pin such that the spring applies a force to the valve actuator arm urging the valve actuator arm in a direction to open the release valve, a retaining link securing screw threadable into a threaded securing screw aperture formed into the valve body, and a lead retaining link connected between the retaining link attachment pin and the retaining link securing screw such that the valve actuator arm is retained in a position maintaining the release valve in a closed position, the lead retaining link being constructed from a lead that melts when exposed to fire, the lead retaining link having a retaining screw aperture and a retaining pin slot formed therethrough, the retaining pin slot including a retaining pin head insertion opening and a retaining pin shaft locking slot, the retaining pin head insertion opening having a diameter "A" that is greater than the diameter of a retaining pin head of the retaining pin and a retaining pin shaft locking slot with a diameter "B" that is greater than the diameter of a retaining pin shaft of the retaining pin and less than the diameter of the retaining pin head.

It is noted that the embodiment of the fire detecting valve activation assembly for vehicle fire suppression systems described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A fire detecting valve activation assembly for vehicle fire suppression systems having a pressurized gas fire suppressant cylinder and a pressurized gas fire suppressant distribution line terminating in a release valve having an actuator shaft for closing and opening the release valve; the fire detecting valve activation assembly comprising:

a nozzle in connection with the release valve such that said nozzle directs a discharge from said release valve in a pattern; and a lead link fire detecting valve activation assembly;

said lead link fire detecting valve activation assembly including:

a valve body within which said release valve is installed such that an exterior portion of said actuator shaft extends out from said valve body, a valve actuator arm having a retaining link attachment pin extending outwardly therefrom, said valve actuator arm being rigidly coupled to said exterior portion of said actuator shaft, a spring anchoring pin extending from said exterior of said valve body, a biasing spring connected between said valve actuator arm and said spring anchoring pin such that said spring applies a force to said valve actuator arm urging said valve actuator arm in a direction to open said release valve, a retaining link securing screw threadable into a threaded securing screw aperture formed into said valve body, and a lead retaining link connected between said retaining link attachment pin and said retaining link securing screw such that said valve actuator arm is retained in a position maintaining said release valve in a closed position, said lead retaining link being constructed from a lead that melts when exposed to fire.

2. The fire detecting valve activation assembly for vehicle fire suppression systems of claim 1, wherein:

said nozzle includes a turnable pattern adjustment fitting.

3. The fire detecting valve activation assembly for vehicle fire suppression systems of claim 1, wherein:

said lead retaining link has a retaining screw aperture and a retaining pin slot formed therethrough, said retaining pin slot including a retaining pin head insertion opening and a retaining pin shaft locking slot, said retaining pin head insertion opening having a diameter "A" that is greater than said diameter of a retaining pin head of said retaining pin and a retaining pin shaft locking slot with a diameter "B" that is greater than said diameter of a retaining pin shaft of said retaining pin and less than said diameter of said retaining pin head.

4. The fire detecting valve activation assembly for vehicle fire suppression systems of claim 3, wherein:

said lead retaining link has a retaining screw aperture and a retaining pin slot formed therethrough, said retaining pin slot including a retaining pin head insertion opening and a retaining pin shaft locking slot, said retaining pin head insertion opening having a diameter "A" that is greater than said diameter of a retaining pin head of said retaining pin and a retaining pin shaft locking slot with a diameter "B" that is greater than said diameter of a retaining pin shaft of said retaining pin and less than said diameter of said retaining pin head.

* * * * *